US010196705B2

(12) United States Patent
Song et al.

(10) Patent No.: US 10,196,705 B2
(45) Date of Patent: Feb. 5, 2019

(54) MARTENSITIC STEEL WITH DELAYED FRACTURE RESISTANCE AND MANUFACTURING METHOD

(71) Applicant: ArcelorMittal, Luxembourg (LU)

(72) Inventors: Rongjie Song, Munster, IN (US); Narayan Pottore, Munster, IN (US); Nina Fonstein, Chicago, IL (US)

(73) Assignee: ArcelorMittal, Luxembourg (LU)

( * ) Notice: Subject to any disclaimer, the term of this patent is extended or adjusted under 35 U.S.C. 154(b) by 270 days.

(21) Appl. No.: 15/103,275

(22) PCT Filed: Dec. 11, 2013

(86) PCT No.: PCT/US2013/074399

§ 371 (c)(1),
(2) Date: Jun. 9, 2016

(87) PCT Pub. No.: WO2015/088514

PCT Pub. Date: Jun. 18, 2015

(65) Prior Publication Data

US 2016/0304981 A1 Oct. 20, 2016

(51) Int. Cl.
*C22C 38/26* (2006.01)
*C22C 38/28* (2006.01)
(Continued)

(52) U.S. Cl.
CPC ..... *C21D 9/46* (2013.01); *C21D 8/021* (2013.01); *C21D 8/0205* (2013.01);
(Continued)

(58) Field of Classification Search
None
See application file for complete search history.

(56) References Cited

U.S. PATENT DOCUMENTS 4,201,574 A 5/1980 Kowaka et al.
8,951,367 B2 2/2015 Kawamura et al.
(Continued)

FOREIGN PATENT DOCUMENTS

CA 2850044 4/2013
CN 102770568 A 11/2012
(Continued)

OTHER PUBLICATIONS

Machine-English translation of JP 2010-150612, Takebayashi Shigeto et al., Jul. 8, 2010.*
(Continued)

*Primary Examiner* — Deborah Yee
(74) *Attorney, Agent, or Firm* — Davidson, Davidson & Kappel, LLC

(57) ABSTRACT

A cold rolled and annealed martensitic steel sheet is provided. The steel sheet includes by weight percent, 0.30≤C≤0.5%, 0.2≤Mn≤1.5%, 0.5≤Si≤3.0%, 0.02≤Ti≤0.05%, 0.001≤N≤0.008%, 0.0010≤B≤0.0030%, 0.01≤Nb≤0.1%, 0.2≤Cr≤2.0%, P≤0.02%, S≤0.005%, Al≤1%, Mo≤1% and Ni≤0.5%. The remainder of the composition includes iron and unavoidable impurities resulting from melting. The microstructure is 100% martensitic and a prior austenite grain size is lower than 20 μm. The steel sheet has a delayed fracture resistance of at least 24 hours during an acid immersion U-bend test. A method, part, structural member and vehicle are also provided.

24 Claims, 2 Drawing Sheets

(51) Int. Cl.

| | |
|---|---|
| ***C22C 38/32*** | (2006.01) |
| ***C21D 9/46*** | (2006.01) |
| ***C21D 8/02*** | (2006.01) |
| ***C22C 38/40*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C21D 8/0226* (2013.01); *C21D 8/0236* (2013.01); *C21D 8/0263* (2013.01); *C21D 8/0273* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/32* (2013.01); *C22C 38/34* (2013.01); *C22C 38/40* (2013.01); *C21D 2211/008* (2013.01)

(56) References Cited

U.S. PATENT DOCUMENTS

| | | | | |
|---|---|---|---|---|
| 2011/0253271 | A1 | 10/2011 | Kumagai et al. | |
| 2013/0095347 | A1* | 4/2013 | Kawasaki et al. .... | B32B 15/013 428/684 |
| 2014/0144559 | A1 | 5/2014 | Zhu et al. | |

FOREIGN PATENT DOCUMENTS

| | | | |
|---|---|---|---|
| JP | 08041535 | | 7/1994 |
| JP | 2005097725 | | 4/2005 |
| JP | 2010248565 | | 11/2010 |
| JP | 2012180594 | | 9/2012 |
| JP | 2013104081 | | 5/2013 |
| RU | 2203965 | C2 | 5/2003 |
| RU | 2235136 | C1 | 8/2004 |
| WO | 2007129676 | | 11/2007 |
| WO | 2012153009 | A1 | 11/2012 |
| WO | 2013082188 | A1 | 11/2012 |

OTHER PUBLICATIONS

Machine English translation of JP 2010-174282, Kobayashi Satoo et al., Aug. 12, 2010.*

Tetsuo Shiraga, Nobuyuki Ishikawa, Moriyuki Ishiguro, Eiji Yamashita, Shigeru Mizoguchi, Effect of Ni, Cu and Si on Delayed Fracture Properties of High Strength Steels with Tensile Strength of 1450N/mm2, CAMP-ISIJ, vol. 7 (1994)-1646-1649.

* cited by examiner

MARTENSITIC STEEL WITH DELAYED FRACTURE RESISTANCE AND MANUFACTURING METHOD

The present invention relates to martensitic steels, for vehicles, which exhibit excellent resistance to delayed fracture resistance. Such steel is intended to be used as structural members and reinforcing materials primarily for automobiles. It also deals with the method of producing the excellent delayed fracture resistance of fully martensitic grade steel.

BACKGROUND

Steel parts of cars are often exposed to environments where atomic hydrogen can be formed and absorbed. The absorbed hydrogen may be in addition to what has already been absorbed during component manufacture. The detrimental effects that hydrogen can cause in steel are: reduce the failure stress of steel, limit ductility and toughness, or even accelerate crack growth within the steel. The failure of steel due to hydrogen attack may occur instantaneously upon loading or after a delayed period of time. This behavior makes it exceptionally difficult to predict failures due to hydrogen embrittlement and can be costly from the standpoint of liability and repairs. In general, susceptibility to hydrogen degradation increases with increasing steel strength, and is more pronounced when the strength of the steel is greater than 1000 MPa.

Thus, several families of steels like the ones mentioned below offering various strength levels have been proposed.

Among those concepts, steels with micro-alloying elements whose hardening is obtained simultaneously by precipitation and by refinement of the ferritic grain size have been developed. The development of such High Strength Low Alloyed (HSLA) steels has been followed by those of higher strength called Advanced High Strength Steels which keep good levels of strength together with good cold formability such as dual phase steels, bainitic steels, TRIP steels but the tensile strength levels that can be reached by such concepts is generally below 1300 MPa.

So as to answer to the demand of steels with even higher strength and at the same time a good formability, a lot of developments took place with, as a challenge, obtaining a steel grade that can withstand hydrogen embrittlement. It leads to martensitic steels with more than 1500 MPa of resistance but delayed fracture issues due to the presence of hydrogen in the steel occurred. In addition, martensitic steels present low formability levels.

The development of martensitic steels is illustrated, for instance, by the international application WO2013082188, such application deals with martensitic steel compositions and methods of production thereof. More specifically, the martensitic steels disclosed in this application have tensile strengths ranging from 1700 to 2200 MPa. Most specifically, the invention relates to thin gage (thickness of 1 mm) and methods of production thereof. However such application is silent when it comes to delayed fracture resistance, it does not teach how to obtain delayed fracture resistant steels.

It is also known the following article "*ISIJ* 1994 (*vol* 7)—*Effect of Ni, Cu and Si on delayed fracture properties of High Strength Steels with tensile strength of* 1450 *by Shiraga*" which teaches positive effect of Ni content on delayed fracture resistance due to hydrogen. However, such document would not result in enough delayed fracture resistance.

SUMMARY OF THE INVENTION

An object of the present invention is to provide a cold rolled and annealed steel with improved resistance, formability and delayed fracture resistance and with a tensile strength of:

- at least 1700 MPa, preferably at least 1800 MPa and even more preferably at least 1900 MPa;
- a yield strength of at least 1300 MPa, preferably at least 1500 MPa and even more preferably at least 1600 MPa;
- a total elongation of at least 3%, preferably at least 5% and even more preferably at least 6%; and
- a delayed fracture resistance of at least 24 hours during acid immersion U-bend test.

The present invention provides a cold rolled and annealed martensitic steel sheet having a delayed fracture resistance of at least 24 hours during acid immersion U-bend test, comprising, by weight percent:

$0.30 \leq C \leq 0.5\%$;
$0.2 \leq Mn \leq 1.5\%$;
$0.5 \leq Si \leq 3.0\%$;
$0.02 \leq Ti \leq 0.05\%$;
$0.001 \leq N \leq 0.008\%$;
$0.0010 \leq B \leq 0.0030\%$;
$0.01 \leq Nb \leq 0.1\%$;
$0.2 \leq Cr \leq 2.0\%$;
$P \leq 0.02\%$;
$S \leq 0.005\%$;
$Al \leq 1\%$;
$Mo \leq 1\%$; and
$Ni \leq 0.5\%$;

the remainder of the composition being iron and unavoidable impurities resulting from the melting and the microstructure is 100% martensitic with prior austenite grain size lower than 20 μm.

Preferably, the cold rolled and annealed martensitic steel sheet is so that $0.01 \leq Nb \leq 0.05\%$.

Preferably, the cold rolled and annealed martensitic steel sheet is so that $0.2 \leq Cr \leq 1.0\%$.

Preferably, the cold rolled and annealed martensitic steel sheet is so that $Ni \leq 0.2\%$, even more preferably $Ni \leq 0.05\%$, and ideally $Ni \leq 0.03\%$.

Preferably, the cold rolled and annealed martensitic steel sheet is so that $1 \leq Si \leq 2\%$.

In a preferred embodiment, the cold rolled and annealed martensitic steel sheet is so that the tensile strength is at least 1700 MPa, the yield strength is at least 1300 MPa and total elongation is at least 3%.

In a preferred embodiment, the cold rolled and annealed martensitic steel sheet is so that the delayed fracture resistance is at least 48 hours during acid immersion U-bend test, more preferably the delayed fracture resistance is at least 100 hours during acid immersion U-bend test, and in another preferred embodiment the delayed fracture resistance is at least 300 hours during acid immersion U-bend test. Ideally, the delayed fracture resistance is at least 600 hours during acid immersion U-bend test.

The invention also provides a method for producing a cold rolled and annealed martensitic steel sheet comprising the following steps, the steps may be performed successively:

- casting a steel which composition is according the invention so as to obtain a slab,
- reheating the slab at a temperature $T_{reheat}$ above 1150° C.,
- hot rolling the reheated slab at a temperature above 850° C. to obtain a hot rolled steel, cooling the hot rolled steel until a coiling temperature $T_{coiling}$ between 500 and 660° C., then coiling the hot rolled steel cooled at $T_{coiling}$, de-scaling the hot rolled steel, cold rolling the steel so as to obtain a cold rolled steel sheet, heating up to a temperature $T_{anneal}$ between Ac3° C. (Austenite formation temperature during heating) and 950° C., annealing at $T_{anneal}$ for a time between 40 seconds and 600 seconds so as to have a 100% austenitic microstructure with a grain size below 20 μm, optionally applying a cooling step to the cold rolled steel from the annealing temperature down to a temperature $T_1$ of at least Ac3° C. at a cooling rate of at least 1° C./s, cooling the cold rolled steel optionally to room temperature at a cooling rate $CR_{quench}$ of at least 100° C./s, and optionally, tempering the cold rolled steel at a temperature between 180° C. and 300° C. for at least 40 seconds.

Preferably, in the method for producing a cold rolled and annealed martensitic steel sheet according to the invention, the cooling rate $CR_{quench}$ is at least 200° C./s.

In a preferred embodiment, in the method for producing a cold rolled and annealed martensitic steel sheet according to the invention, the cooling rate $CR_{quench}$ is at least 500° C./s.

Preferably, in the method for producing a cold rolled and annealed martensitic steel sheet according to the invention, the austenitic grain size formed during annealing at $T_{anneal}$ for a time between 40 seconds and 600 seconds is below 15 μm.

The cold rolled and annealed steel according to the invention can be used to produce a part for a vehicle.

The cold rolled and annealed steel according to the invention can be used to produce structural members for a vehicle.

BRIEF DESCRIPTION OF THE DRAWINGS

A preferred embodiment and main aspects of the present invention will now be described with reference to the drawings in which.

DETAILED DESCRIPTION

Figure 1:
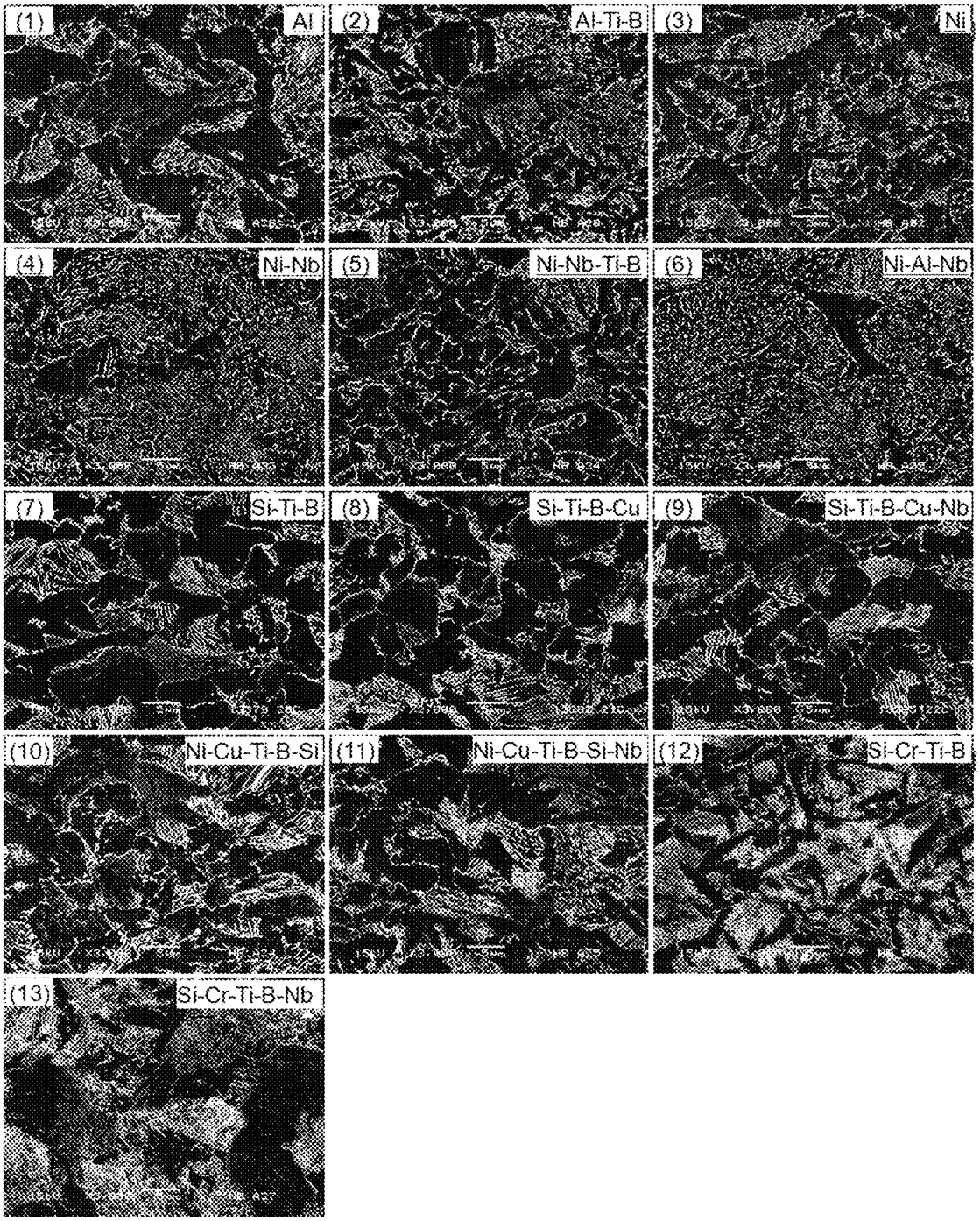
FIG. 1 illustrates the microstructures of the hot rolled steels of steels.

To obtain the martensitic steel sheet according to the invention, the chemical composition is very important as well as the production parameters so as to reach all the objectives and to obtain an excellent delayed fracture resistance. Nickel content below 0.5% is needed to reduce H embrittlement, carbon content between 0.3 and 0.5% is needed for tensile properties and Si content above 0.5% also for H embrittlement resistance improvement.

The following chemical composition elements are given in weight percent.

As for carbon: the increase in content above 0.5 wt. % would increase the number of grain boundary carbides, which are one of the major causes for deterioration of delayed fracture resistance of steel. However, carbon content of at least 0.30 wt. % is required in order to obtain the strength of steel targeted, i.e., 1700 MPa of tensile strength and 1300 MPa of yield strength. The carbon content should therefore be limited within a range of from 0.30 to 0.5 wt. %. Preferably, the carbon is limited within a range between 0.30 and 0.40%.

Manganese increases the sensitivity to delayed fracture of high strength steel. The formation of MnS inclusion tends to be a starting point of crack initiation induced by hydrogen, for this reason manganese content is limited to a maximum amount of 1.5 wt. %. Reducing Mn content below 0.2 wt. % would be detrimental to cost and productivity as the usual residual content is above that level. The manganese content should therefore be limited to $0.2 \leq Mn \leq 1.5$ wt. %. Preferably, $0.2 \leq Mn \leq 1.0$ wt. % and even more preferably, $0.2 \leq Mn \leq 0.8$ wt. %.

Silicon: A minimum amount of 0.5 wt. % is needed to reach the targeted properties of the invention because Si improves delayed fracture resistance of steel due to:

Reduction of hydrogen diffusion kinetic and $H_2$ formation prevention, and

Inhibition of carbide formation during optional tempering process.

Above 3.0 wt. % silicon content, the steel coatability deteriorates. The added amount of Si is therefore limited to a range of 0.5 wt. % to 3.0 wt. %. preferably, $1.2\% \leq Si \leq 1.8\%$.

With regard to titanium, the addition of less than 0.02 wt. % titanium would result in low delayed fracture resistance of the steel of the invention which would crack in less than 50 hours during acid immersion U-bend test. Indeed, Ti is needed for hydrogen trapping effect by Ti(C, N) precipitates. Ti is also needed to act as a strong nitride former (TiN), Ti_protects boron from reaction with nitrogen; as a consequence boron will be in solid solution in the steel. In addition, Titanium precipitates pin the prior austenite grain boundary, it thus allows having fine final martensitic structure since prior austenite grain size will be below 20 μm. However, Ti content above 0.05 wt. % would lead to coarse Ti containing precipitates and those coarse precipitates will lose their grain boundary pinning effect. The desired titanium content is therefore between 0.01 and 0.05 wt. %. Preferably Ti content is between 0.02 and 0.03 wt. %.

Nitrogen contents below 0.001 wt. % decrease nitrides precipitates in steel, leading to a coarser structure of the steel due to less pinning effect by precipitates. In addition, coarse microstructures present less volume of grain boundaries which increases crack propagation kinetic. The results will be the deterioration of delayed fracture resistance of steel. However, at nitrogen content above 0.008 wt. %, nitrides in the steel become coarser, thus reducing the grain size pinning effect leading to a deterioration of the delayed fracture resistance of the steel. The nitrogen content should therefore be limited within a range of 0.001 to 0.008 wt. %.

Boron should remain in solid solution to improve steel hardenability. Below 0.0010 wt. %, boron does not contribute enough to the grain boundary strengthening which is needed to reach the excellent delayed fracture of the steel of present invention. In addition, due to significantly faster diffusion to grain boundaries than phosphorous, boron prevents the adverse effect of phosphorous segregations on said grain boundaries which would deteriorate delayed fracture resistance. However, above 0.0030 wt. %, carboborides can form. Thus, boron is added from 10 to 30 ppm.

The desired niobium content is between 0.01 and 0.1 wt. %. A Nb content lower than 0.01 wt. % does not provide enough prior austenite grain refinement effect. While with a Nb content of more than 0.1 wt. %, there is no further grain refinement Preferably, the Nb content is so that $0.01 \leq Nb \leq 0.05$ wt. %.

As for chromium: above 2.0 wt. %, the delayed fracture resistance is not improved and additional Cr increases production cost. Below 0.2 wt. % of Cr, the delayed fracture resistance would be below expectations. The desired chromium content is between 0.2-2.0 wt. %. Preferably, the Cr content is so that 0.2≤Cr≤1.0 wt. %.

Aluminum has a positive effect on delayed fracture resistance. However, this element is an austenite stabilizer, it increases the Ac3 point for full austenitization before cooling during the annealing, since full austenitization is required to obtain fully martensitic microstructure, Al content is limited to 1.0 wt. % for energy saving purpose and to avoid high annealing temperatures which would lead to prior austenite grain coarsening.

As for nickel, prior art documents such as "*ISIJ* 1994 (*vol* 7)—*Effect of Ni, Cu and Si on delayed fracture properties of High Strength Steels with tensile strength of* 1450 *by Shiraga*" teaches that adding nickel is beneficial to delayed fracture resistance. Contrary to prior art teachings, the inventors have surprisingly found that nickel has a negative impact on delayed fracture resistance in the alloys of the present invention. For this reason, nickel content is limited to 0.5 wt. %, preferably, Ni content is lower than 0.2 wt. %, even more preferably, Ni content is lower than 0.05 wt. % and ideally, the steel contains Ni at impurity level, which is below 0.03 wt. %.

Molybdenum content is limited to 1 wt. % for cost issues, in addition no improvement has been identified on delayed fracture resistance while adding Mo. Preferably, the molybdenum content is limited to 0.5 wt. %.

As for phosphorus, at contents over 0.02 wt. %, phosphorus segregates along grain boundaries of steel and causes the deterioration of delayed fracture resistance of the steel sheet. The phosphorus content should therefore be limited to 0.02 wt. %.

As for sulphur, contents over 0.005 wt % lead to a large amount of non-metallic inclusions (MnS), and this causes the deterioration of delayed fracture resistance of the steel sheet. Consequently, the sulphur content should be limited to 0.005 wt. %.

Hydrogen degradation is often observed as intergranular fracture by brittle cleavage or interface separation, depending on the relative strength of the grain boundaries. It is believed that the intergranular embrittlement can be caused by the combination of impurity (e.g., P, S, Sb and Sn) segregation on grain boundaries during austenitization, and cementite (Fe3C) precipitation along grain boundaries during tempering. The extent of impurity segregation, and thus of embrittlement, is enhanced by the presence of Mn in the alloy. Therefore, in the present invention, the contents of S, Sb, Sn and P are preferably limited as low as possible.

The method to produce the steel according to the invention implies casting steel with the chemical composition of the invention.

The cast steel is reheated above 1150° C. When slab reheating temperature is below 1150° C., the steel will not be homogeneous and precipitates will not be completely dissolved.

Then the slab is hot rolled, the last hot rolling pass taking place at a temperature $T_{lp}$ of at least 850° C. If $T_{lp}$ is below 850° C., hot workability is reduced and cracks will appear and the rolling forces will increase. Preferably, the $T_{lp}$ is at least 870° C.

Cooling the steel down to the coiling temperature Tcoiling.

Tcoiling is between 500° C. and 660° C.

After coiling, the hot rolled steel is de-scaled.

Cold rolling the steel with a cold rolling ratio that will depend on final targeted thickness and is preferably between 30 and 80%.

The subsequent soaking treatment is then performed:

Heating the steel up to the annealing temperature Tanneal which must be between Ac3 and 950° C.

Annealing the steel at the temperature Tanneal between Ac3 and 950° C. for at least 40 seconds in the fully austenitic region so as to form 100% of austenite with a grain size below 20 μm before quenching. Controlling the annealing temperature is an important feature of the process since it enables to control the prior austenite grain size in addition to the 100% austenitic structure before quench. Below Ac3, ferrite is present and its presence would change austenite chemical composition and decrease the steel tensile strength below the targeted 1700 MPa, furthermore, the presence of ferrite would create a second phase in the steel that would be very soft compared the hard martensite obtained after quench. The co-existence of these two phases with big hardness difference is deleterious for In Use Properties like hole expansion or bendability. Preferably, the annealing is done within 40 and 300 seconds and the temperature is preferably between 850 and 900° C.

The prior austenite has to be below 20 μm because mechanical properties and delayed fracture resistance of the present invention are improved, when the size is smaller than 20 μm. preferably, it is below 15 μm.

Then the cold rolled steel is cooled in at least one step. In a preferred embodiment according to the invention, the steel is first cooled at a cooling rate CR1 above 1° C./s down to a temperature above 820° C. that is still above Ac3 temperature. Ac3 being the temperature below which ferrite might appear in this cooling step. This first cooling step is optional. Below 1° C./s austenite grain growth will take place, leading to coarse martensite grains detrimental to delayed fracture resistance and mechanical properties.

Then, the cold rolled steel is further rapidly cooled to room temperature at a cooling rate CR2 above 100° C./s in a second cooling step, preferably CR2≥200° C./s and even more preferably CR2≥500° C./s so that the final microstructure is made of small size martensite. Below 100° C./s, coarse martensite grains will appear or even ferrite and this would be detrimental respectively to delayed fracture resistance or tensile strength.

After the cooling either to room temperature or to tempering temperature, the steel is reheated and held at a temperature between 180° C. to 300° C. for at least 40 seconds for a tempering treatment beneficial to the steel ductility. Below 180° C., the tempering would have no effect on ductility and the fully martensitic structure would have a brittle behaviour. Above 300° C., more carbides formation decreases steel strength and deteriorates delayed fracture resistance.

Martensite is the structure formed after cooling the austenite formed during annealing. The martensite is further tempered during the post tempering process step. One of the effects of such tempering is the improvement of ductility and delayed fracture resistance. The martensite content has to be 100%, the targeted structure of the present invention is a fully martensitic one.

The optional tempering treatment after rapid cooling $CR_2$ according to the present invention can be performed by any suitable means, as long as the temperature and time stay within the claimed ranges.

In particular, induction annealing can be performed on the uncoiled steel sheet, in a continuous way.

Another preferred way to perform such tempering treatment is to perform a so called batch annealing on a coil of the steel sheet.

Depending on the target values of mechanical properties, the man skilled in the art knows how to define the steel composition and the tempering parameters (time and temperature) to reach the properties of the invention while staying within claimed ranges of the invention.

After the tempering treatment, the coating can be done by any suitable method including, electro-galvanizing, vacuum coatings (jet vapour deposition), or chemical vapour coatings, for example. Preferably, electro-deposition of Zn coating is applied.

Abbreviations:

TS (MPa) refers to the tensile strength measured by tensile test (ASTM) in the longitudinal direction relative to the rolling direction, YS (MPa) refers to the yield strength measured by tensile test (ASTM) in the longitudinal direction relative to the rolling direction, The Yield ratio is the ratio between YS and TS.

TE1 (%) refers to the total elongation measured by tensile test (ASTM) in the longitudinal direction relative to the rolling direction, UE1 (%) refers to the uniform elongation measured by tensile test (ASTM) in the longitudinal direction relative to the rolling direction, N.E: Not evaluated Analysis Methods:

Microstructures were observed using a SEM at the quarter thickness location and revealed all to be fully martensitic.

As for the mechanical properties, flat sheet tensile specimens using ASTM E 8 standard (transversal direction for hot rolled steels and longitudinal direction for annealed steels) were prepared for room temperature tensile test. The tests were conducted at a constant cross-head speed of 12.5 mm/min and the gauge range of extensometer was 50 mm.

Regarding the delayed fracture resistance, the test consists of bending a flat rectangular specimen to a desired stress level of 85% Tensile Strength (TS), or to 90% TS at the maximum bend followed by relaxation to a stress state of 85% TS. The steel is deformed at 85% TS before immersing into 0.1 N HCl acid (pH=1).

A strain gauge is glued at the geometric center of U-bend sample to monitor the maximum strain change during bending. Based on the full stress-strain curve measured using a standard tensile test, i.e., the correlation between strain and TS, the targeting percentage of TS during U bending can be accurately defined by adjusting strain (e.g., the height of bending). The U-bend samples under a restrained stress of 85% TS are then immersed into 0.1 N HCl to ascertain if cracks form. The longer time of crack occurrence, the better the delayed fracture resistance of steel. Results are presented in the form of a range because some crack occurrence may be noticed some hours after cracking took place, for example, overnight without immediate crack reporting.

The martensitic transformation point is measured using the following formula:

$$Ms\ (^\circ C.)=539-423\%\ C-30.4Mn\ \%-17.7\%\ Ni-12.1\%\ Cr-7.5\%\ Mo\ (\text{in wt. }\%).$$

The temperature at which a fully austenitic structure is reached upon heating during annealing, Ac3, is calculated using Thermo-Calc software known per se by the man skilled in the art.

Without being bound to this theory, an austenitic microstructure develops during annealing. The austenitic microstructure changes into a martensitic microstructure during cooling to room temperature. Consequently, the martensite grain size is a function of the prior austenite grain size prior to cooling. The martensite grain size plays a significant role in the delayed fracture resistance and mechanical properties. A smaller austenite grain size before cooling and during the soaking, results in a smaller martensite grain size which provides better delayed fracture resistance. Therefore, in accordance with the present invention, a prior austenite grain size below 20 μm is desired to keep the material from cracking during U-bend test in less than 1 day (24 hours). The prior austenite grain size may be detected using an EBSD, electron backscatter diffraction, technique on the resulting martensitic microstructure after cooling.

All samples of the examples have undergone the same thermo-mechanical path:

Example Trials:

The steels used in the examples below have the following chemical compositions:

TABLE 1

| | Chemical composition (wt %) | | | | | | | | | | | | | | |
|---|---|---|---|---|---|---|---|---|---|---|---|---|---|---|---|
| Steel | C | Mn | P | S | Si | Al | Cr | Ni | Cu | Nb | Ti | B | N | Ms, C | Ac3 |
| 1 Al | 0.35 | 0.50 | 0.007 | 0.001 | 0.2 | 0.721 | | | | | | | 0.0025 | 373 | 867 |
| 2 Al—Ti—B | 0.35 | 0.51 | 0.003 | 0 | 0.2 | 0.735 | | | | | 0.025 | 0.002 | 0.0036 | 376 | 871 |
| 3 Ni | 0.34 | 0.49 | 0.002 | 0 | 0.2 | 0.053 | | 1.0 | | | | | 0.0032 | 363 | 779 |
| 4 Ni—Nb | 0.34 | 0.49 | 0.002 | 0 | 0.2 | 0.053 | | 1.0 | | 0.028 | | | 0.0034 | 364 | 780 |
| 5 Ni—Nb—Ti—B | 0.33 | 0.50 | 0.002 | 0 | 0.2 | 0.050 | | 1.0 | | | 0.025 | 0.002 | 0.0032 | 365 | 781 |
| 6 Ni—Al—Nb | 0.36 | 0.50 | 0.003 | 0 | 0.2 | 0.749 | | 1.0 | | 0.030 | | | 0.0024 | 354 | 840 |
| 7 Si—Ti—B | 0.32 | 0.49 | 0.002 | 0.001 | 1.5 | 0.042 | | | | | 0.025 | 0.002 | 0.0038 | 388 | 849 |
| 8 Si—Ti—B—Cu | 0.34 | 0.48 | 0.002 | 0.001 | 1.5 | 0.046 | | | 0.15 | | 0.024 | 0.002 | 0.0035 | 379 | 844 |
| 9 Si—Ti—B—Cu—Nb | 0.32 | 0.48 | 0.003 | 0.001 | 1.5 | 0.041 | | | 0.15 | 0.029 | 0.024 | 0.002 | 0.0037 | 388 | 849 |
| 10 Ni—Cu—Ti—B—Si | 0.31 | 0.50 | 0.003 | 0 | 1.5 | 0.057 | | 0.12 | 0.24 | | 0.025 | 0.002 | 0.0027 | 390 | 847 |
| 11 Ni—Cu—Ti—B—Si—Nb | 0.31 | 0.49 | 0.004 | 0 | 1.5 | 0.052 | | 0.12 | 0.23 | 0.030 | 0.024 | 0.002 | 0.0030 | 391 | 849 |
| 12 Si—Cr—Ti—B | 0.32 | 0.49 | 0.003 | 0.001 | 1.5 | 0.052 | 0.5 | | | | 0.025 | 0.002 | 0.0030 | 383 | 848 |
| 13 Si—Cr—Ti—B—Nb | 0.32 | 0.49 | 0.003 | 0.001 | 1.5 | 0.052 | 0.5 | | | 0.028 | 0.025 | 0.002 | 0.0027 | 382 | 849 |

For the upstream process, after reheating and austenitization at 1250° C. for 3 hours, the laboratory cast 50 kg slabs with the chemistry listed in table 1 were hot rolled from 65 mm to 20 mm in thickness on a laboratory mill. The finishing rolling temperature was 870° C. The plates were air cooled after hot rolling.

After shearing and reheating the pre-rolled 20 mm thick plates to 1250° C. for 3 hours, the plates were hot rolled to 3.4 mm. After controlled cooling at an average cooling rate of 45° C./s from finish rolling temperature to less than 660° C., the hot rolled steel of each composition is held in a furnace at a temperature of 620° C. for 1 hour, followed by a 24-hour furnace cooling to simulate industrial coiling process. The coiling temperature CT is given in ° C.

Both surfaces of the hot rolled steels were ground to remove any decarburized layer.

For the downstream process, after cold reduction to a thickness of 1.0 mm, sample coupons were subjected to salt pot treatments to simulate the soaking treatment. Said soaking treatment implied heating the 1.0 mm thick cold rolled specimens to 900° C., isothermally holding it for 100 seconds to simulate annealing, followed by a first step cooling to 880° C. Then, the samples were water quenched (WQ), which is a cooling system leading to cooling rates significantly above 100° C./s. They were then heated, tempered at 200° C. for 100 seconds and air cooled to room temperature (final cooling).

The microstructures of the hot rolled steel sheets 1 to 13 are illustrated by FIG. 1 where ferrite is in black and carbide containing phase such as pearlite is in white.

Table 2 & 3 below show the process parameters for respectively hot rolled and cold rolled steels:

TABLE 2

| Hot rolling parameters | | | | | | |
|---|---|---|---|---|---|---|
| | Steel-ASTM-L | re-heating T° (° C.) | Re-heating time (hours) | finish rolling T° | Coiling T° (° C.) | Cold Rolling |
| 1 | Al | 1250 | 3 | 875 | 620 | 65 |
| 2 | Al—Ti—B | 1250 | 3 | 870 | 620 | 66 |
| 3 | Ni | 1250 | 3 | 870 | 620 | 65 |
| 4 | Ni—Nb | 1250 | 3 | 874 | 620 | 66 |
| 5 | Ni—Nb—Ti—B | 1250 | 3 | 871 | 620 | 65 |
| 6 | Ni—Al—Nb | 1250 | 3 | 876 | 620 | 65 |
| 7 | Si—Ti—B | 1250 | 3 | 873 | 620 | 65 |
| 8 | Si—Ti—B—Cu | 1250 | 3 | 880 | 620 | 65 |
| 9 | Si—Ti—B—Cu—Nb | 1250 | 3 | 877 | 620 | 66 |
| 10 | Ni—Cu—Ti—B—Si | 1250 | 3 | 874 | 620 | 68 |
| 11 | Ni—Cu—Ti—B—Si—Nb | 1250 | 3 | 879 | 620 | 69 |
| 12 | Si—Cr—Ti—B | 1250 | 3 | 873 | 620 | 63 |
| 13 | Si—Cr—Ti—B—Nb | 1250 | 3 | 875 | 620 | 65 |

TABLE 3

| Cold rolling parameters | | | | | | | | |
|---|---|---|---|---|---|---|---|---|
| Steel-ASTM-L | soaking temperature | soaking time | first step cooling end | cooling rate to 880° C. | Final cooling | tempering T° | tempering time | final cooling |
| 1 Al | 900° C. | 100 s | 880° C. | 5° C./S | WQ | 200° C. | 100 s | Air Cooling |
| 2 Al—Ti—B | 900° C. | 100 s | 880° C. | 5° C./S | WQ | 200° C. | 102 s | Air Cooling |
| 3 Ni | 900° C. | 100 s | 880° C. | 5° C./S | WQ | 200° C. | 101 s | Air Cooling |
| 4 Ni—Nb | 900° C. | 100 s | 880° C. | 5° C./S | WQ | 200° C. | 101 s | Air Cooling |
| 5 Ni—Nb—Ti—B | 900° C. | 100 s | 880° C. | 5° C./S | WQ | 200° C. | 100 s | Air Cooling |
| 6 Ni—Al—Nb | 900° C. | 100 s | 880° C. | 5° C./S | WQ | 200° C. | 101 s | Air Cooling |
| 7 Si—Ti—B | 900° C. | 100 s | 880° C. | 5° C./S | WQ | 200° C. | 102 s | Air Cooling |
| 8 Si—Ti—B—Cu | 900° C. | 100 s | 880° C. | 5° C./S | WQ | 200° C. | 100 s | Air Cooling |
| 9 Si—Ti—B—Cu—Nb | 900° C. | 100 s | 880° C. | 5° C./S | WQ | 200° C. | 101 s | Air Cooling |
| 10 Ni—Cu—Ti—B—Si | 900° C. | 100 s | 880° C. | 5° C./S | WQ | 200° C. | 102 s | Air Cooling |
| 11 Ni—Cu—Ti—B—Si—Nb | 900° C. | 100 s | 880° C. | 5° C./S | WQ | 200° C. | 101 s | Air Cooling |
| 12 Si—Cr—Ti—B | 900° C. | 100 s | 880° C. | 5° C./S | WQ | 200° C. | 100 s | Air Cooling |
| 13 Si—Cr—Ti—B—Nb | 900° C. | 100 s | 880° C. | 5° C./S | WQ | 200° C. | 101 s | Air Cooling |

As can be seen from table 4 below, no hot rolled steel presents a tensile strength above 850 MPa; this allows cold rolling to be performed on conventional cold rolling mills. If the material is too hard, cracks may appear during cold rolling or the final targeted thickness is not reached due to too hard hot rolled steel.

TABLE 4

Hot rolled steels mechanical properties (transversal direction)

| | Sample name | TEL (%) | UEL (%) | YS (MPa) | TS (MPa) |
|---|---|---|---|---|---|
| 1 | Al | 24.6 | 14.1 | 378 | 588 |
| 2 | Al—Ti—B | 21.5 | 13.1 | 435 | 619 |
| 3 | Ni | 24.7 | 12.4 | 389 | 611 |
| 4 | Ni—Nb | 24.7 | 12.9 | 494 | 635 |
| 5 | Ni—Nb—Ti—B | 29.6 | 11.6 | 452 | 637 |
| 6 | Ni—Al—Nb | 23.5 | 13.1 | 543 | 684 |
| 7 | Si—Ti—B | 22.9 | 14.2 | 476 | 715 |
| 8 | Si—Ti—B—Cu | 22.4 | 13.7 | 499 | 731 |
| 9 | Si—Ti—B—Cu—Nb | 22.7 | 14.2 | 521 | 724 |
| 10 | Ni—Cu—Ti—B—Si | 22.4 | 13.9 | 507 | 729 |
| 11 | Ni—Cu—Ti—B—Si—Nb | 22.8 | 13.5 | 532 | 740 |
| 12 | Si—Cr—Ti—B | 17.4 | 10.1 | 656 | 839 |
| 13 | Si—Cr—Ti—B—Nb | 15.3 | 9.3 | 620 | 845 |

It can clearly be seen from table 5 below that steels 1 to 6 are not resistant to delayed fracture due to their short time of crack occurrence. These concepts fail during the U-Bend test after less than 1 day and sometimes even in less than 6 hours (¼ day). This is due at least to their Si content of 0.2 wt. % (cf. table 1).

Figure 2:
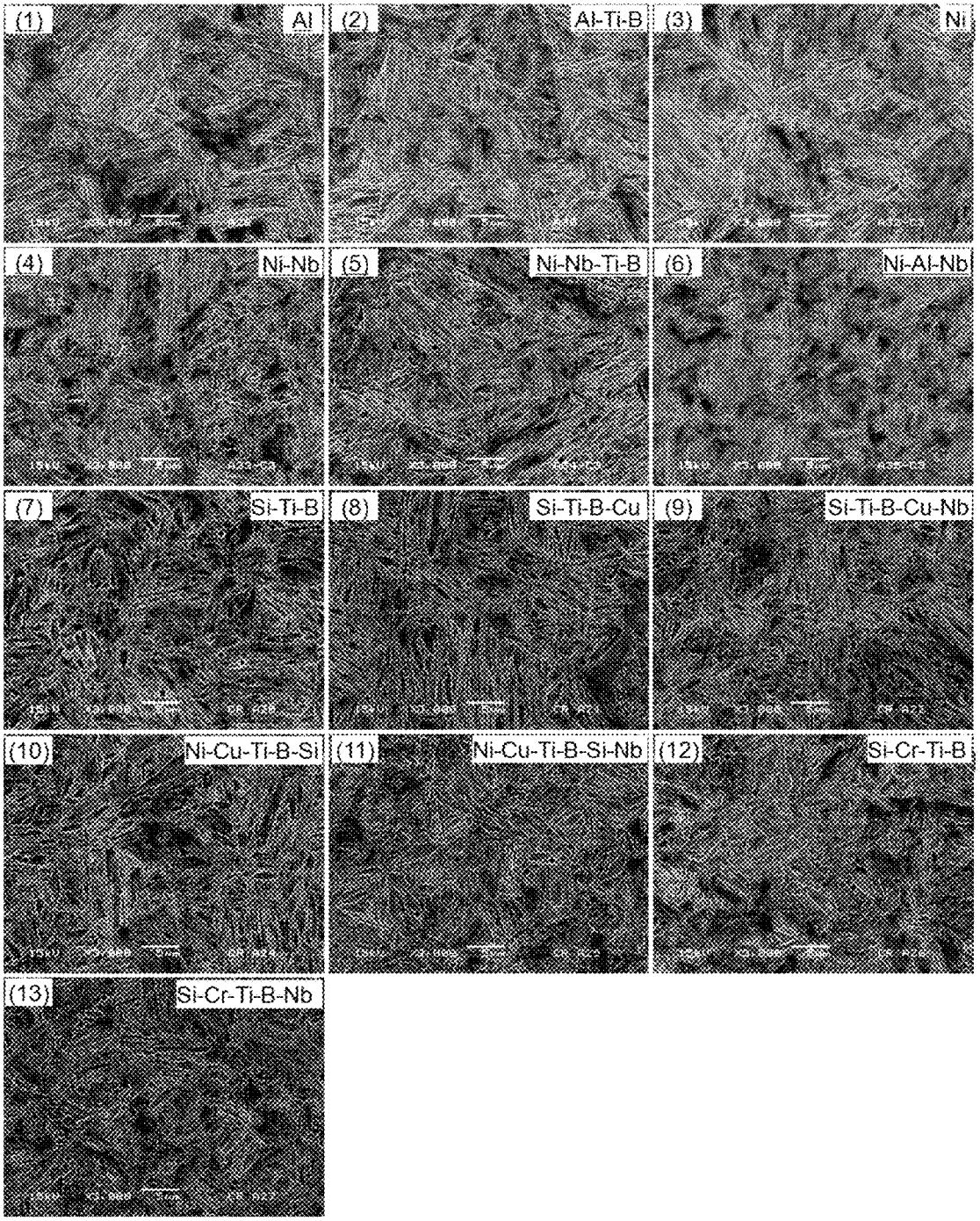
FIG. 2 illustrates the microstructure of cold rolled annealed martensitic steels

As shown by the steels 7-13 in table 3, the addition of Nb in steels improves delayed fracture resistance obviously. This can be attributed to the effects of Nb precipitates on grain refinement and on providing more H trapping sites. The annealed 100% martensitic steels have the microstructures illustrated in FIG. 2 and the mechanical properties as well as the delayed fracture resistance test results are given in table 5.

TABLE 5 mechanical properties of cold rolled and annealed steels 1 to 13

| | Steel-ASTM-L | TEI (%) | U(EI) % | YS (MPa) | UTS (MPa) | Yiled Ratio | Time before crack in hours during U-bend test | prior austenite grain size |
|---|---|---|---|---|---|---|---|---|
| 1 | Al | 5.9 | 3.9 | 1588 | 1970 | 0.81 | 8-21 hrs | N.E |
| 2 | Al—Ti—B | 5.5 | 3.7 | 1598 | 1978 | 0.81 | 8-21 hrs | N.E |
| 3 | Ni | 6.4 | 3.8 | 1564 | 1924 | 0.81 | 3.5 hrs | N.E |
| 4 | Ni—Nb | 5.0 | 3.5 | 1681 | 1986 | 0.85 | 3.5 hrs | N.E |
| 5 | Ni—Nb—Ti—B | 5.6 | 3.8 | 1544 | 1918 | 0.81 | 5 hrs | N.E |
| 6 | Ni—Al—Nb | 5.6 | 3.9 | 1693 | 2028 | 0.83 | 6.5 hrs | N.E |
| 7 | Si—Ti—B | 5.7 | 4.1 | 1647 | 2033 | 0.81 | 37 hrs | <20 μm |
| 8 | Si—Ti—B—Cu | 5.6 | 4.0 | 1622 | 2012 | 0.81 | 57-72 hrs | <20 μm |
| 9 | Si—Ti—B—Cu—Nb | 6.7 | 4.8 | 1656 | 2014 | 0.82 | 80-144 hr | <20 μm |
| 10 | Ni—Cu—Ti—B—Si | 6.0 | 4.4 | 1560 | 1931 | 0.81 | 57-72 hrs | <20 μm |
| 11 | Ni—Cu—Ti—B—Si—Nb | 5.4 | 3.9 | 1611 | 1964 | 0.82 | 217 hrs | <20 μm |
| 12 | Si—Cr—Ti—B | 5.9 | 4.2 | 1610 | 1990 | 0.81 | 80-144 hr | <20 μm |
| 13 | Si—Cr—Ti—B—Nb | 6.5 | 4.4 | 1684 | 2039 | 0.83 | >600 hrs | 10-15 μm |

The steel references 7 to 13 are according to the invention, steel 13 presents the best in class results with more than 12 days without crack during this acid immersion delayed fracture test (U-bend) with YS of at least 1600 MPa, tensile strength of at least 1900 MPa and total elongation of at least 6%.

The prior austenite grain sizes can be assessed using EBSD technique. In the case of steel 13, such values, based on at least three pictures, result in grain sizes which are between 10 and 15 μm.

The steel according to the present invention may be used for automotive body in white parts.

What is claimed is:

1. A martensitic steel sheet, directly obtained after cold rolling, annealing and cooling, comprising, by weight percent:

0.30≤C≤0.5%;
0.2≤Mn≤1.5%;
0.5≤Si≤3.0%;
0.02≤Ti≤0.05%;
0.001≤N≤0.008%;
0.0010≤B≤0.0030%;
0.01≤Nb≤0.1%;
0.2≤Cr≤2.0%;
P≤0.02%;
S≤0.005%;
Al≤1%;
Mo≤1%; and
Ni≤0.5%;

the remainder of the composition being iron and unavoidable impurities resulting from melting;

a microstructure being 100% tempered martensitic with a prior austenite grain size lower than 20 μm;

the steel sheet having a delayed fracture resistance of at least 24 hours during an acid immersion U-bend test.

2. The cold rolled and annealed martensitic steel sheet according to claim 1 wherein 0.01≤Nb≤0.05%.

3. The cold rolled and annealed martensitic steel sheet according to claim 1 wherein 0.2≤Cr≤1.0%.

4. The cold rolled and annealed martensitic steel sheet according to claim 1 wherein Ni≤0.2%.

5. The cold rolled and annealed martensitic steel sheet according to claim 1 wherein Ni≤0.05%.

6. The cold rolled and annealed martensitic steel sheet according to claim 1 wherein Ni≤0.03%.

7. The cold rolled and annealed martensitic steel sheet according to claim 1 wherein 1≤Si≤2%.

8. The cold rolled and annealed martensitic steel sheet according to claim 1 wherein a tensile strength is at least 1700 MPa, a yield strength is at least 1300 MPa and a total elongation is at least 3%.

9. The cold rolled and annealed martensitic steel sheet according to claim 1 wherein the delayed fracture resistance is at least 100 hours during the acid immersion U-bend test.

10. The cold rolled and annealed martensitic steel sheet according to claim 1 wherein the delayed fracture resistance is at least 300 hours during the acid immersion U-bend test.

11. The cold rolled and annealed martensitic steel sheet according to claim 1 wherein the delayed fracture resistance is at least 600 hours during the acid immersion U-bend test.

12. A method for producing a cold rolled and annealed martensitic steel sheet according to claim 1 comprising the steps of:

casting a steel so as to obtain a slab;

reheating the slab at a temperature $T_{reheat}$ above 1150° C.;

hot rolling the reheated slab at a temperature above 850° C. to obtain a hot rolled steel;

cooling the hot rolled steel until a coiling temperature $T_{coiling}$ between 500 and 660° C.;

coiling the hot rolled steel cooled at $T_{coiling}$;

de-scaling the hot rolled steel;

cold rolling the steel so as to obtain a cold rolled steel sheet;

heating up to a temperature $T_{anneal}$ between Ac3° C. and 950° C., annealing at $T_{anneal}$ for a time between 40 seconds and 600 seconds so as to have a 100% austenitic microstructure with a grain size below 20 μm;

cooling the cold rolled steel to room temperature or tempering temperature at a cooling rate $CR_{quench}$ of at least 100 C/s; and tempering the cold rolled sheet at a temperature between 180° C. and 300° C. for at least 40 seconds.

13. The method for producing a cold rolled and annealed martensitic steel sheet according to claim 12 wherein the cooling rate $CR_{quench}$ is at least 200° C./s.

14. The method for producing a cold rolled and annealed martensitic steel sheet according to claim 13 wherein the cooling rate $CR_{quench}$ is at least 500° C./s.

15. The method for producing a cold rolled and annealed martensitic steel sheet according to claim 12 wherein the austenitic grain size formed during annealing at $T_{anneal}$ for a time between 40 seconds and 600 seconds is below 15 μm.

16. A part for a vehicle comprising: the cold rolled and annealed martensitic steel according to claim 1.

17. A structural member comprising:

a cold rolled and annealed martensitic steel according to claim 1.

18. A vehicle comprising:

a part made of a cold rolled and annealed martensitic steel according to claim 1.

19. The method for producing a cold rolled and annealed martensitic steel sheet according to claim 12 further comprising the step of applying a cooling step to the cold rolled steel from the annealing temperature down to a temperature $T_1$ of at least 820° C. at a cooling rate of at least 1° C./s.

20. The method for producing a cold rolled and annealed martensitic steel sheet according to claim 12 further comprising the step of tempering the cold rolled steel at a temperature between 180° C. and 300° C. for at least 40 seconds.

21. The method for producing a cold rolled and annealed martensitic steel sheet according to claim 12 wherein the steps are performed in succession.

22. A part for a vehicle comprising: the cold rolled and annealed martensitic steel produced according to claim 12.

23. A structural member comprising:

a cold rolled and annealed martensitic steel produced according to claim 12.

24. A vehicle comprising:

a part made of a cold rolled and annealed martensitic steel produced according to claim 12.

* * * * *